US007498915B1

(12) United States Patent
Leupold

(10) Patent No.: US 7,498,915 B1
(45) Date of Patent: Mar. 3, 2009

(54) APPLICATION OF SUPERCONDUCTIVE PERMANENT MAGNETS

(75) Inventor: Herbert A. Leupold, Eatontown, NJ (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 376 days.

(21) Appl. No.: 11/288,059

(22) Filed: Nov. 18, 2005

(51) Int. Cl.
*H01F 7/00* (2006.01)
*H01F 3/00* (2006.01)

(52) U.S. Cl. ..... 335/296; 335/216

(58) Field of Classification Search ..... 335/296–299, 335/302

See application file for complete search history.

(56) References Cited

U.S. PATENT DOCUMENTS

| | | | | |
|---|---|---|---|---|
| 4,829,277 | A * | 5/1989 | Stahura et al. | 335/306 |
| 4,999,600 | A * | 3/1991 | Aubert | 335/306 |
| 6,545,474 | B2 * | 4/2003 | Nakamura et al. | 324/318 |
| 7,026,901 | B2 * | 4/2006 | Yanagi et al. | 335/296 |

* cited by examiner

*Primary Examiner*—Elvin G Enad
*Assistant Examiner*—Bernard Rojas
(74) *Attorney, Agent, or Firm*—Michael Zelenka'; George B. Tereschuk

(57) ABSTRACT

A fixed remanence rigid permanent magnetic structure is provided. The fixed remanence rigid permanent magnetic structure is fabricated from a number of superconductive magnetic segments composed of high temperature superconductive particles. The superconductive magnetic segments are characterized by unusually high transition temperatures and a capacity to trap magnetic flux. The fixed remanence permanent magnetic structure provides a fixed magnetic remanence B in the interior working space and offers stronger magnetic fields than currently available rigid permanent magnets.

11 Claims, 2 Drawing Sheets

APPLICATION OF SUPERCONDUCTIVE PERMANENT MAGNETS

GOVERNMENT INTEREST

The invention described herein may be manufactured, used, imported, sold, and licensed by or for the Government of the United States of America without the payment to me of any royalty thereon.

FIELD OF THE INVENTION

The present invention relates to permanent magnets. More particularly, the present invention relates to devices and methods for providing a fixed remanence superconductive magnetic structure.

BACKGROUND OF THE INVENTION

The advent of rigid permanent magnets has afforded near revolutionary progress in magnetic technology with substantial advancements in magnetic field strength, structural compactness and design simplicity. The term "rigid" as used in this context is defined as the constancy of magnetization, M, that these materials can afford. Thus, a rigid magnet is one whose magnetization, M, is not affected by demagnetizing fields engendered by the geometry of the structure into which the magnet is placed. The use of a rigid permanent magnets with a constant magnetization, M, that is unaffected by the demagnetizing influences of the surrounding structure permits arranging an array of permanent magnets so that the surrounding structure's magnetic poles work to the designer's best advantage without demagnetizing the magnets. Accordingly, the individual magnetic fields of rigid permanent magnets may be summed in order to compute their total magnetic effect when the rigid permanent magnets are correctly aligned.

To better understand constant magnetization M magnetic structures it is useful to consider the relationship between magnetic remanence, B, magnetic field, H, and magnetization M. When assembling a magnetic structure such as a magic ring, the conditions of rigidity of magnetization $\vec{M}$ and the satisfaction of various boundary conditions leads the values of magnetic remanence $\vec{B}$ and magnetic field $\vec{H}$ to be held constant within any single segment. The three quantities are related by the fundamental equation:

$$\vec{B}=\vec{H}+\vec{M}$$

where magnetic remanence $\vec{B}$ magnetic field $\vec{H}$ and magnetization $\vec{M}$ are expressed in units of magnetic flux density, such as Heavyside units. In a conventional permanent magnet structure composed of rigid magnetic segments, $\vec{M}$ is the fixed quantity while $\vec{B}$ and $\vec{H}$ are the variable quantities that adjust themselves to satisfy the boundary conditions of Maxwell's equations. FIGS. 1 and 2 illustrate one such implementation where the rigid permanent magnet segments are assembled into a magic ring. FIG. 1 depicts a group of wedge-shaped magic ring segments 11 with their respective individual magnetic fields, as represented by small arrows 12-14, and an overall magnetization direction 15 in the midst of the segments 11. FIG. 2 depicts the FIG. 1 group of wedge-shaped magic ring segments 11 assembled into a magic ring 20 wherein the individual magnetic fields 12-14 of the magic ring segments 11 provide a composite magnetic field represented by large arrow 21 in the interior working space to provide a constant magnetization, M. The same configuration would also result if it was possible to hold either of the other two quantities, i.e. $\vec{B}$ or $\vec{H}$, to a fixed value. In that case, $\vec{M}$ and the other unfixed member of the $\vec{M}$, $\vec{B}$ and $\vec{H}$ triad would then adjust themselves.

Although it is possible to fix magnetic remanence or magnetic field, B, constant in such magnetic structures, up until now the magnetic fields generated in rigid permanent magnetic structures using conventional materials, such as SmCo, NdFe and PtCo were generally about 20,000-30,000 Gauss. The limitations of rigid permanent magnetic structures fabricated from conventional materials have created a longstanding need for fixed remanence B permanent magnetic structures with stronger magnetic fields. Additionally, a fixed remanence B permanent magnetic structure can also give rise to a higher magnetization, M. Finally, it would also be very desirable to construct magnetic structures having a fixed magnetic remanence, $\vec{B}$, in the interior working space, an increased magnetic field and a higher magnetization, M, but currently this cannot be done easily due to the limitations of conventional magnetic materials.

The possibility of holding $\vec{B}$ to a fixed value along with a constant magnetization M can now be realized through the use of high temperature superconductive segments that exhibit an unusually high capacity for trapped magnetic flux. Previously unavailable high temperature superconductive magnetic segments now make it possible to configure a permanent magnetic structure composed of rigid particles in such a way that $\vec{B}$ can is fixed at different local values in such a way that magnetization $\vec{M}$ remains constant over a larger segment as a whole, without suffering from the drawbacks, shortcomings and limitations of constant magnetization M structures fabricated with conventional materials.

SUMMARY OF THE INVENTION

In order to answer the long-felt need for rigid permanent magnetic structures with a fixed magnetic remanence, $\vec{B}$, and a stronger interior magnetic field, the present invention provides rigid permanent magnetic structures comprising fixed remanence magnetic segments composed of high temperature superconductive materials having a high capacity for trapped magnetic flux. The recent advent of certain high temperature superconductors characterized by unusually high transition temperatures up to more than 100° K. now permit developing a fixed remanence magnetic structure and confirms the possibility of fabricating a constant magnetic remanence B structure. Some of the superconductive materials show a constancy of remanence B over large regions of their hysteresis curves wherein many magnets in electronic devices operate, and this also reinforces the feasibility of using the fixed remanence superconductive magnets of the present invention. Stronger magnetic fields are now readily achievable with this invention's rigid permanent magnetic structures comprising fixed remanence magnetic segments composed of high temperature superconductive materials having a high capacity for trapped magnetic flux.

Initially, it may appear that fixed remanence magnets offer no advantage over constant M types because equivalent distributions are obtainable with either approach, but some fixed remanence superconducting magnets offer stronger magnetic fields in more useful magnet structures than currently available rigid permanent magnets. At present, such superconducting magnets are usually anisotropic and it is necessary to cut, configure and orient the superconductive magnetic segment in a configuration that enhances the capacity for flux-trapping.

Thus, it is now possible to answer the long-felt need for rigid permanent magnetic structures with a fixed magnetic remanence, $\vec{B}$, structure and stronger magnetic fields. The present invention's rigid permanent fixed remanence magnetic structures are composed of high temperature superconductor materials that exhibit a high capacity for trapped magnetic flux, without suffering from the shortcomings, disadvantages and limitations of current rigid permanent magnetic structures.

It is an object of the present invention to provide a magnetic device with a fixed magnetic remanence, B.

It is another object of the present invention to provide a fixed remanence rigid permanent magnetic structure comprising high temperature superconductive magnetic segments that provide a fixed magnetic remanence B in an interior working space and a stronger magnetic field.

It is yet another object of the present invention to provide a method for achieving a fixed magnetic remanence B in an interior working space of a magnetic structure.

These and other objects and advantages are accomplished by this invention's fixed remanence rigid permanent magnetic structure comprising superconductive magnetic segments composed of high temperature superconductor particles characterized by unusually high transition temperatures, up to over 100° K., as well as the capacity to trap magnetic flux, which provides a fixed magnetic remanence B in the interior working space. This invention's fixed remanence permanent magnetic structure offers stronger magnetic fields than currently available rigid permanent magnets. The fixed remanence rigid permanent magnetic structure composed of superconductive segments answers the long-felt need for a fixed remanence B magnetic structure without suffering from the drawbacks, shortcomings and limitations of the low magnetic fields from conventional rigid permanent magnetic structures. The present invention also contemplates methods for achieving a fixed magnetic remanence B in an interior working space of a permanent magnetic structure composed of high temperature superconductive magnetic segments and a fixed remanence permanent magic ring device.

DETAILED DESCRIPTION OF THE DRAWINGS

The present invention resolves the long-standing problems, shortcomings and limitations of rigid permanent magnetic structures with low magnetic fields with a fixed magnetic remanence B permanent magnetic structure composed of high temperature superconductive magnetic segments that provide a higher magnetization, M, a fixed magnetic remanence $\vec{B}$ in the interior working space and a stronger magnetic field at the same time. The devices, techniques and methods of the present invention allow assembly of multiple superconductive magnetic segments in such a way so as to trap the desired magnetic flux. In accordance with the present invention, a fixed remanence rigid permanent magnetic structure comprising superconductive magnetic segments answers the long-felt need for rigid permanent magnetic structures with stronger magnetic fields. The superconductive magnetic segments are composed of high temperature superconductive particles providing a fixed magnetic remanence, $\vec{B}$, higher magnetization, M, and a stronger magnetic field concurrently, without suffering from the shortcomings, limitations and drawbacks of rigid permanent magnetic structures built with conventional materials.

Each superconductive magnetic segment of the present invention is characterized by an unusually high transition temperature above 100° K., an advantageous capacity to trap magnetic flux and a stronger magnetic field than the currently available conventional rigid permanent magnet. Inasmuch as superconductive magnetic segments are usually anisotropic, it is necessary to form and orient the segments in a way that the desired magnetic flux density B occurs in the most advantageous direction along an easy axis of flux-trapping to maximize magnetic remanence B. This is accomplished by placing particles of superconductive materials in an external magnetic field, fabricating superconductive magnetic segments from the superconductive particles exposed to the external magnetic field, cooling the superconductive magnetic segments below the transition temperature and assembling the superconductive magnetic segments into the desired magnetic structure.

Figure 1:
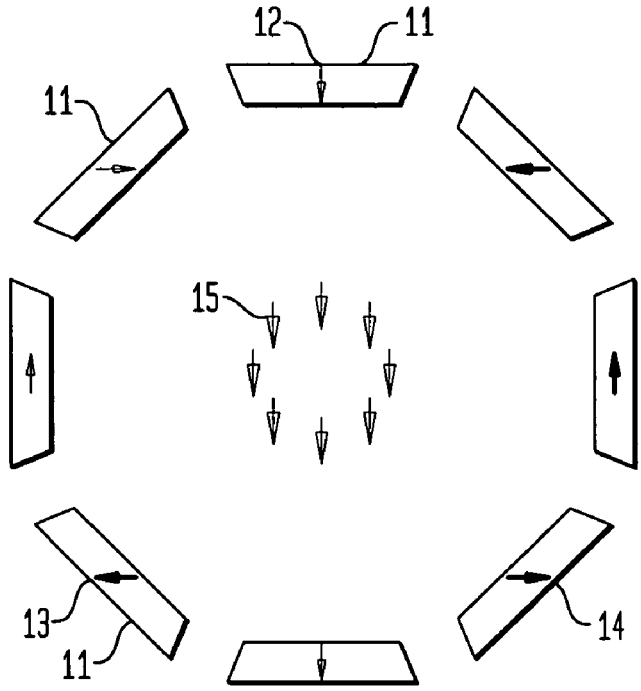
FIG. 1 depicts a group of wedge-shaped magic ring segments and various directions of magnetization.
Figure 2:
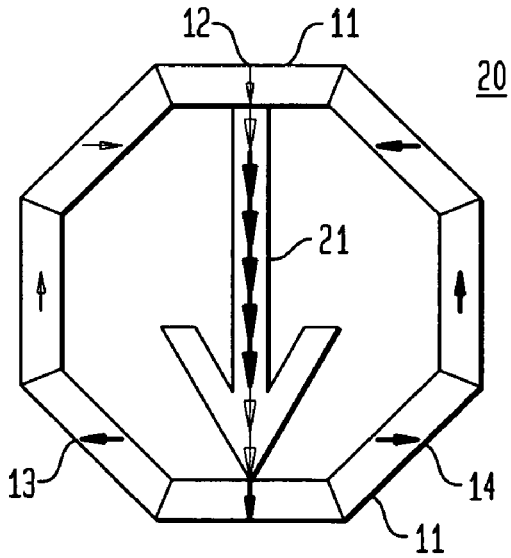
FIG. 2 illustrates one implementation of wedge-shaped magic ring segments assembled into a magic ring structure.
Figure 3A:
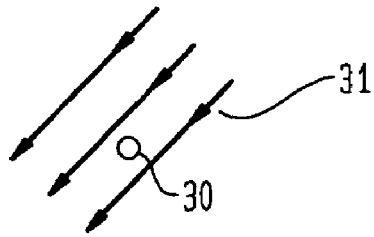
FIGS. 3A-3C illustrate the magnetic influences and fields involved in fabricating and assembling the superconductive magnetic segments of the fixed remanence rigid permanent magnetic structure of the present invention.
Figure 3B:
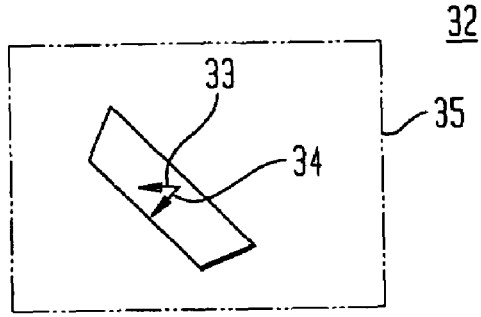
Figure 3C:
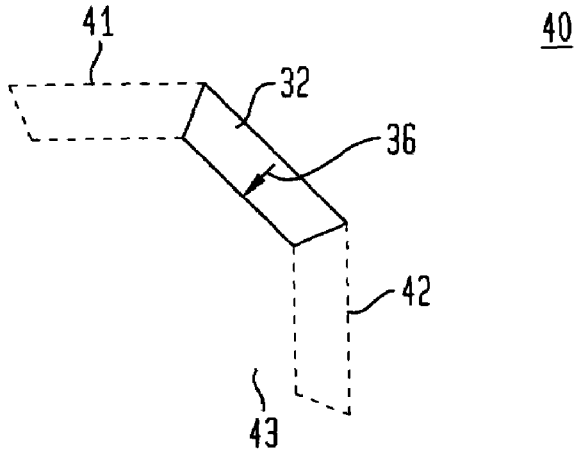

Referring now to the drawings, FIGS. 3A-3C depict the significant magnetic fields, forces and influences involved in fabricating superconductive magnetic segments into the fixed remanence rigid permanent magnet structure of the present invention. FIG. 3A depicts a single superconductive particle 30 being exposed to an external magnetic field, represented by bold arrows 31. Each superconductive particle 30 initially exhibits a given transition temperature and a predetermined magnetic flux density. The external magnetic field 31 generates an increased magnetic flux density in each superconductive particle 30. After a sufficient number of superconductive particles 30 are exposed to the external magnetic field 31, the superconductive particles 30 are aligned and shaped into a number of superconductive magnetic segments 32. FIG. 3A depicts a single superconductive particle 30, but the size, amount, granularity and consistency of the superconductive particles 30 will vary with the superconductive material that the designer selects and the specific implementation.

FIG. 3B depicts a single superconductive magnetic segment 32 where small arrow 33 represents the desired magnetization direction M and small arrow 34 represents the desired magnetic remanence B, or flux density. The superconductive magnetic segment 32 is now cooled below the given transition temperature to a sub-transition temperature in a means for cooling, represented by box 35. Cooling the superconductive magnetic segment 32 to the sub-transition temperature traps the increased magnetic flux density within the superconductive magnetic segment 32. Referring now to FIG. 3C, the cooled superconductive magnetic segment 32 provides an increased constant magnetic flux density B, represented by small arrow 36. Broken line segments 41 and 42 adjacent to superconductive magnetic segment 32 represent other superconductive magnetic segments being assembled into a magic ring structure 40 having an interior working space 43. When the superconductive magnetic segments, each having a constant magnetic remanence B in accordance with the present invention, are correctly assembled into a permanent magnetic structure, such as the magic ring structure 40, they will generate an overall unidirectional magnetization M in the interior working space 43.

In accordance with the present invention, it is necessary to maintain the sub-transition temperature of the superconductive magnetic segment 32 during assembly and operation of the fixed remanence permanent magnetic structure. The assembly of the superconductive magnetic segment 32 in a cold environment should be mechanically feasible with present technology and should not be major concern because the requisite refrigeration technology is becoming more readily available. Maintaining the sub-transition temperatures in space applications would be useful because low temperatures are easily available there. The superconductive magnetic segments 32 may be wedges or shaped differently. Although FIG. 3C depicts a number of superconductive magnetic segments shaped into a magic ring structure 40, other magnetic shapes and configurations are also within the contemplation of the devices of the present invention. A number of variations of the fixed remanence rigid permanent magnet structure of the present invention are also possible, including forming the superconductive magnetic segments 32 into wedges, shaping them in a different geometry or constructing different magnetic structures, shapes and configurations.

The present invention also encompasses methods for achieving a fixed magnetic remanence B in an interior working space of a permanent magnetic structure, comprising the steps of selecting a group of superconductive particles with a given transition temperature and a predetermined magnetic flux density; generating an external magnetic field; exposing a number of superconductive particles to the external magnetic field; generating an increased magnetic flux density, B, in the superconductive particles, the increased magnetic flux density having a magnetic remanence greater than the predetermined magnetic flux density; forming a group of superconductive magnetic segments from the superconductive particles, the superconductive magnetic segments having a capacity to trap magnetic flux; cooling the superconductive magnetic segments below the given transition temperature to a sub-transition temperature; and trapping the increased magnetic flux density within each of the superconductive magnetic segments. The method of the present invention continues with the steps of maintaining the sub-transition temperature; assembling the superconductive magnetic segments into a magnetic flux structure that defines an interior working space; and generating an overall unidirectional magnetization M from the increased magnetic flux density in an interior working space.

FIGS. 3A-3C also illustrate a number of the steps of the method of the present invention. FIG. 3A depicts the exposing step where a single superconductive magnetic particle 30 is exposed to the external magnetic field, represented by bold arrows 31. A superconductive particle 30 initially exhibits a given transition temperature and a predetermined magnetic flux density. During the exposing step, an increased magnetic flux density is generated in the superconductive particles 30. After the superconductive particles 30 are exposed to the external magnetic field 31, the superconductive particles 30 are aligned and shaped into a group of superconductive magnetic segments 32. FIG. 3B depicts a single superconductive magnetic segment 32, with small arrow 33 representing the desired magnetization direction M and small arrow 34 representing the desired magnetic remanence, or flux density, $\vec{B}$. FIG. 3B also shows the cooling step by depicting the superconductive segment 32 inside a cooling means 35. FIG. 3C depicts the cooled superconductive magnetic segment 32 providing an increased magnetic flux density represented by small arrow 36. Broken line segments 42 and 43 adjacent to superconductive magnetic segment 32 represent other superconductive magnetic segments being assembled into a magic ring structure 40. When the superconductive magnetic segments, each having a constant magnetic remanence B in accordance with the present invention, are correctly assembled into a permanent magnetic structure, such as the magic ring structure 40, they will generate an overall unidirectional magnetization, M, in the interior working space 43.

A number of variations of the method of the present invention are also possible, including forming the superconductive magnetic segments 31 into wedges or shaping them in a different geometry. Although FIG. 3C depicts arranging a number of superconductive magnetic segments into a magic ring 40, the assembly step would permit positioning the segments into other different magnetic shapes and configurations.

It is to be further understood that other features and modifications to the foregoing detailed description are within the contemplation of the present invention, which is not limited by this detailed description. Those skilled in the art will readily appreciate that any number of configurations of the present invention and numerous modifications and combinations of materials, components, arrangements and dimensions can achieve the results described herein, without departing from the spirit and scope of this invention. Accordingly, the present invention should not be limited by the foregoing description, but only by the appended claims.

I claim:

1. A fixed remanence rigid permanent superconductive magnet structure, comprising;

a plurality of superconductive particles, having a given transition temperature of about 100° K. and a predetermined magnetic flux density, are exposed to an external magnetic field;

said external magnetic field generates an increased magnetic flux density within said plurality of superconductive particles;

said plurality of superconductive particles being aligned and shaped into a plurality of superconductive magnetic segments, each of said plurality of superconductive magnetic segments having an axis of flux-trapping, a high capacity for trapping magnetic flux, and said increased magnetic flux density, said increased magnetic flux density having a magnetic remanence greater than said predetermined magnetic flux density;

a means for cooling cools said plurality of superconductive magnetic segments to a sub-transition temperature lower than said given transition temperature and traps said increased magnetic flux density within each of said plurality of superconductive segments to provide a plurality of cooled superconductive magnetic segments;

said sub-transition temperature being maintained; and said plurality of cooled superconductive magnetic segments, each having a constant magnetic remanence, B, being assembled into said superconductive magnet structure, generate an overall unidirectional magnetization direction, M, and a fixed magnetic remanence, $\vec{B}$, in an interior working space defined by said superconductive magnet structure.

2. The fixed remanence rigid permanent superconductive magnet structure, as recited in claim 1, further comprising said increased magnetic flux density being a fixed amount.

3. The fixed remanence rigid permanent superconductive magnet structure, as recited in claim 2, further comprising said plurality of cooled superconductive magnetic segments being assembled into said superconductive magnet structure adjacent to one another.

4. The fixed remanence rigid permanent superconductive magnet structure, as recited in claim 3, further comprising each of said plurality of cooled superconductive magnetic segments being wedge-shaped.

5. A method for achieving a fixed magnetic remanence, B, in a rigid permanent superconductive magnet structure comprising the steps of:

selecting a plurality of superconductive particles with a given transition temperature of about 100° K. and a predetermined magnetic flux density;

generating an external magnetic field;

exposing said plurality of superconductive particles to said external magnetic field to generate an increased magnetic flux density within said plurality of superconductive particles;

forming a plurality of superconductive magnetic segments by aligning and shaping said plurality of superconductive particles, each of said plurality of superconductive magnetic segments having an axis of flux-trapping, a high capacity for trapping magnetic flux, and said increased magnetic flux density, said increased magnetic flux density having a magnetic remanence greater than said predetermined magnetic flux density;

cooling said plurality of superconductive magnetic segments to a sub-transition temperature lower than said given transition temperature in a means for cooling;

providing a plurality of cooled superconductive magnetic segments, wherein said increased magnetic flux density is trapped within each of said plurality of cooled superconductive magnetic segments;

maintaining said sub-transition temperature;

assembling said plurality of cooled superconductive magnetic segments into said superconductive magnet structure, each of said plurality of cooled superconductive magnetic segments having said fixed magnetic remanence, B; and generating an overall unidirectional magnetization direction, M, and a fixed magnetic remanence, $\vec{B}$, in an interior working space defined by said superconductive magnet structure.

6. The method for achieving the fixed magnetic remanence, B, in the rigid permanent superconductive magnet structure, as recited in claim 5, wherein said increased magnetic flux density is a fixed amount.

7. The method for achieving the fixed magnetic remanence, B, in the rigid permanent superconductive magnet structure, as recited in claim 6, further comprising the step of assembling said plurality of cooled superconductive magnetic segments adjacent to one another in said superconductive magnet structure.

8. The method for achieving the fixed magnetic remanence, B, in the rigid permanent superconductive magnet structure, as recited in claim 7, further comprising the step of shaping each of said plurality of cooled superconductive magnetic segments as a wedge.

9. A fixed remanence rigid permanent superconductive magnetic device, comprising:

a plurality of superconductive particles, having a given transition temperature of about 100° K. and a predetermined magnetic flux density, are exposed to an external magnetic field;

said external magnetic field generates an increased magnetic flux density within said plurality of superconductive particles;

said plurality of superconductive particles being aligned and shaped into a plurality of superconductive magnetic segments, each of said plurality of superconductive magnetic segments having an axis of flux-trapping, a high capacity for trapping magnetic flux, and said increased magnetic flux density, said increased magnetic flux density having a magnetic remanence greater than said predetermined magnetic flux density;

said plurality of superconductive magnetic segments being wedge-shaped;

a means for cooling cools said plurality of superconductive magnetic segments to a sub-transition temperature lower than said given transition temperature and traps said increased magnetic flux density within each of said plurality of superconductive magnetic segments to provide a plurality of cooled superconductive magnetic segments;

said sub-transition temperature being maintained; and said plurality of cooled superconductive magnetic segments, each having a constant magnetic remanence, B, being assembled into said superconductive magnetic device, generate an overall unidirectional magnetization direction, M, and a fixed magnetic remanence, $\vec{B}$, in an interior working space defined by said superconductive magnet device.

10. The fixed remanence rigid permanent superconductive magnetic device, as recited in claim 9, further comprising said increased magnetic flux density being a fixed amount.

11. The fixed remanence rigid permanent superconductive magnetic device, as recited in claim 10, further comprising said plurality of cooled superconductive magnetic segments being assembled into said superconductive magnetic device adjacent to one another.

* * * * *